US011833824B2

(12) United States Patent
Nitobe et al.

(10) Patent No.: US 11,833,824 B2
(45) Date of Patent: Dec. 5, 2023

(54) LIQUID STORING CONTAINER AND PRINTING APPARATUS

(71) Applicant: CANON KABUSHIKI KAISHA, Tokyo (JP)

(72) Inventors: Satoru Nitobe, Kanagawa (JP); Noriko Sato, Kanagawa (JP); Shingo Horita, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 2 days.

(21) Appl. No.: 17/670,032

(22) Filed: Feb. 11, 2022

(65) Prior Publication Data

US 2022/0258473 A1 Aug. 18, 2022

(30) Foreign Application Priority Data

Feb. 17, 2021 (JP) ..... 2021-023401

(51) Int. Cl.
*B41J 2/165* (2006.01)
*B41J 2/175* (2006.01)

(52) U.S. Cl.
CPC ..... *B41J 2/16523* (2013.01); *B41J 2/17509* (2013.01)

(58) Field of Classification Search
CPC ..... B41J 2/16523; B41J 2/17509
See application file for complete search history.

(56) References Cited

U.S. PATENT DOCUMENTS 5,831,647 A * 11/1998 Kawakami ..... B41J 29/02 347/108
6,663,233 B2 12/2003 Otsuka et al. ..... 347/85
6,685,308 B2 2/2004 Yoshida et al. ..... 347/85
6,783,215 B2 8/2004 Yoshida et al. ..... 347/85
6,837,921 B2 1/2005 Inoue et al. ..... 96/6
6,948,803 B2 9/2005 Yoshida et al. ..... 347/85
6,966,631 B2 11/2005 Matsuo et al. ..... 347/49
7,118,194 B2 10/2006 Matsuo et al. ..... 347/49
7,661,790 B2 2/2010 Harada et al. ..... 347/36
2003/0007045 A1 1/2003 Yoshida et al. ..... 347/86
2003/0007047 A1 1/2003 Otsuka et al. ..... 347/89

(Continued)

FOREIGN PATENT DOCUMENTS

EP 2246193 11/2010
JP H09300655 A * 11/1997
JP 2009-045943 3/2009

OTHER PUBLICATIONS

U.S. Appl. No. 17/670,433, filed Feb. 12, 2022.
Extended European Search Report dated Jun. 27, 2022 in counterpart EP Application No. 22156956.9.

*Primary Examiner* — Sharon Polk
(74) *Attorney, Agent, or Firm* — Venable LLP

(57) ABSTRACT

Provided is a waste liquid storing container capable of reducing imbalance in the absorption of waste liquid in an absorber that absorbs waste liquid. The liquid storing container includes a liquid absorber that absorbs liquid, a casing that houses the liquid absorber, a discharge portion that discharges liquid down in a direction of gravitational force into the casing, and an introduction space into which the liquid from the discharge portion is introduced. The liquid storing container further includes a liquid divider provided inside the introduction space to divide the liquid discharged from the discharge portion.

14 Claims, 11 Drawing Sheets

(56) References Cited

U.S. PATENT DOCUMENTS

| | | | | |
|---|---|---|---|---|
| 2008/0129777 | A1 | 6/2008 | Watanabe | 347/36 |
| 2009/0179941 | A1 | 7/2009 | Harada et al. | 347/31 |
| 2014/0176643 | A1 | 6/2014 | Komaki | 347/36 |
| 2020/0290381 | A1 | 9/2020 | Yoda et al. | B41J 2/16523 |

* cited by examiner

LIQUID STORING CONTAINER AND PRINTING APPARATUS

BACKGROUND OF THE INVENTION

Field of the Invention

The present disclosure relates to a liquid storing container including an absorber that absorbs liquid and to a printing apparatus that performs printing by ejecting liquid from a printhead and that includes a liquid storing container for storing the liquid discharged from the printhead.

Description of the Related Art

In a printing apparatus that performs printing by ejecting ink from a printhead, discharge processing is performed to force part of ink existent in the printhead to be discharged from ejection ports in order to keep the ejection by the printhead favorable. To this end, a printing apparatus of this type is equipped with a liquid storing container for storing waste ink discharged by the discharge processing.

Japanese Patent Laid-Open No. 2009-45943 discloses a liquid storing container mounted in a printing apparatus that uses a pigment ink or a high-concentration ink. In this liquid storing container, an absorber that absorbs waste ink is housed. An introduction space for introducing the waste ink is formed in the absorber, and the waste ink is discharged from a discharge portion provided above the introduction space to the introduction space. This configuration can reduce accumulation of a nonvolatile component contained in the ink, such as a pigment, in the vicinity of the discharge portion, so that the absorber can smoothly absorb the discharged ink.

SUMMARY OF THE INVENTION

However, in the technique disclosed in Japanese Patent Laid-Open No. 2009-45943, in a case where the printing apparatus is used while being tilted as a whole, the waste ink discharged into the introduction space flows down in the direction of gravitational force, and the waste ink may become absorbed only by part of the absorber, resulting in imbalance in the absorption of the waste ink in the absorber. In a case where the waste ink storing container having such imbalance in the absorption of the waste ink in the absorber is tilted even more during, e.g., transport or disposal after use, the amount of waste ink flowing in may exceed the absorption limit of the absorber, and there is a risk of the waste ink seeping through the waste ink storing container.

The present disclosure has been made in view of the above problem and has an object to provide a liquid storing container and a printing apparatus that can reduce imbalance in the absorption of liquid in an absorber that absorbs liquid.

The present disclosure provides a liquid storing container including: a liquid absorber that absorbs liquid; a casing that houses the liquid absorber; a discharge portion that discharges liquid down in a direction of gravitational force into the casing; an introduction space into which the liquid from the discharge portion is introduced; and a liquid divider provided inside the introduction space to divide the liquid discharged from the discharge portion.

The present disclosure can reduce imbalance in the absorption of liquid in an absorber that absorbs liquid.

Further features of the present invention will become apparent from the following description of exemplary embodiments with reference to the attached drawings.

DESCRIPTION OF THE EMBODIMENTS

Figure 1A:
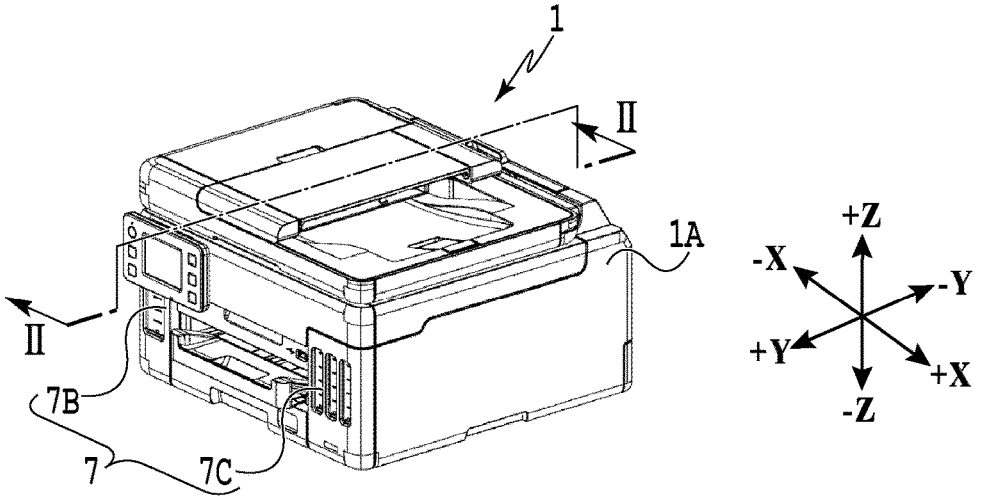
FIGS. 1A to 1C are each a perspective view showing the external appearance of a printing apparatus of the present embodiment.

Embodiments of a printing apparatus according to the present disclosure are described in detail with reference to the drawings. Note that the embodiments below are not intended to limit the invention according to the scope of claims. While a plurality of features are described in the embodiments, not all of these features are necessarily essential to the present disclosure, and the features may be combined appropriately. Further, in the accompanying drawings, the configurations of the same or corresponding portions may be denoted by the same reference numerals to omit repetitive description.

Herein, "printing" includes not only formation of significant information such as text and graphics, but also formation of insignificant information and is also irrespective of whether the information is manifested to be visually perceptible by human. "Printing" also includes not only an operation to form an image, a design, a pattern, or the like on a printing medium, but also processing of a medium.

In addition, a "printing medium" herein includes not only printing paper used in a typical image formation apparatus, but also a conveyable medium such as a cloth, a plastic film (OHP), a metal plate, glass, ceramics, wood, leather, and the like. Further, "ink" (which may also be referred to as "liquid") refers to liquid to be used in formation of an image, a design, a pattern or the like or processing of a printing medium by being applied to a printing medium or in processing of ink (e.g., solidification or insolubilization of a color material in an ink to be applied to a printing medium).

First Embodiment

Figure 1B:
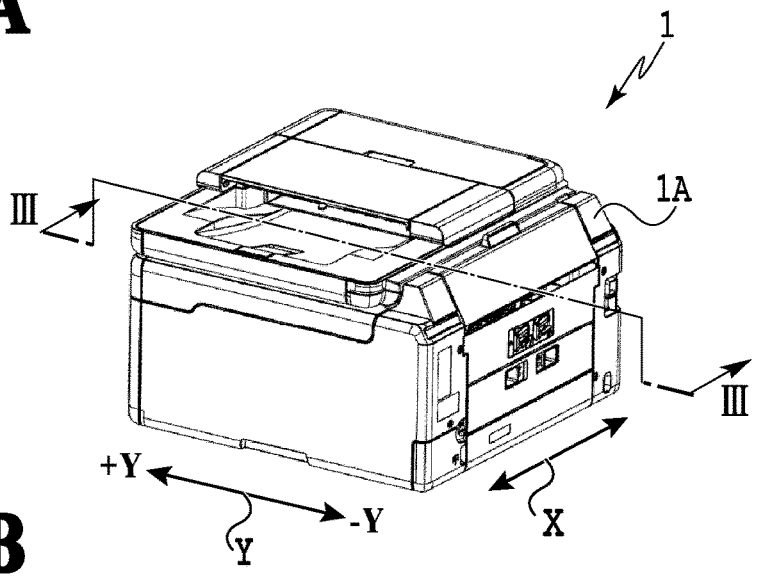
Figure 1C:
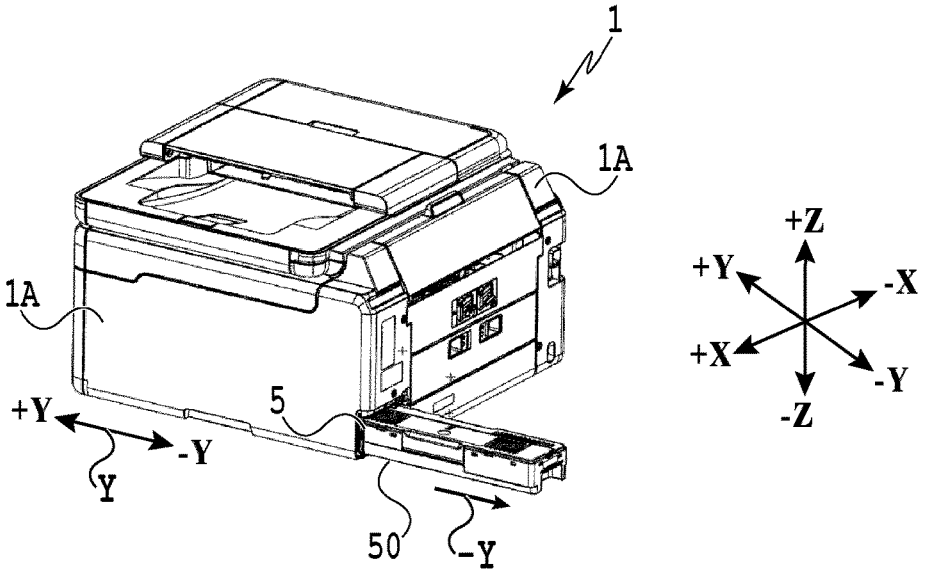

A printing apparatus in the present embodiment is an ink jet printing apparatus that performs printing by ejecting ink from a printhead so that the ink lands on a printing medium. FIGS. 1A to 1C are each a perspective view showing the external appearance of a printing apparatus 1. FIG. 1A is a perspective view showing the front face of the printing apparatus 1 from above at an angle, and FIGS. 1B and 1C are perspective views showing the back face of the printing apparatus 1 from above at an angle. Note that in the following description, the direction of gravitational force is a Z-direction, a +Z-direction being the upward direction of gravitational force and a −Z-direction being the downward direction of gravitational force. Also, the direction orthogonal to the front face of the printing apparatus 1 is a Y-direction, a +Y-direction being a direction directed frontward from the front face and a −Y-direction being a direction directed rearward (toward the back) from the front face. Further, the right direction and the left direction as viewed standing in front of the printing apparatus 1 are a +X-direction and a −X-direction, respectively. Note that the basic usage posture of the printing apparatus 1 is such that the bottom surface of a printing apparatus main body 1 A forming the outer shell of the printing apparatus 1 is parallel to the XY-plane as shown in FIGS. 1A to 1C.

As shown in FIG. 1A, a plurality of ink tanks 7B, 7C are disposed at the front side of the printing apparatus 1. In the present embodiment, a plurality of ink tanks 7C for storing color inks such as a cyan ink, a magenta ink, and a yellow ink are disposed at the front right side of the printing apparatus main body 1A, and an ink tank 7B for storing a black ink is disposed at the front left side of the printing apparatus main body 1A. Note that the ink tanks 7B, 7C may be referred to as ink tanks 7 collectively in the following description.

The plurality of ink tanks 7 each have a filling portion (not shown) through which to fill the ink tank 7 with ink. The user fills the ink tank 7 with ink stored in an ink bottle or an ink pack for ink refill through the filling portion and thereby refills the ink tank 7 with the ink. The ink retained in the ink tank 7 is supplied, via a tube (not shown), to a printhead 3 mounted on a carriage 33 (see FIG. 2) capable of reciprocating in the main scanning direction (the X-direction). A plurality of ejection ports through which to eject ink (liquid) are formed at the printhead 3. Provided inside each ejection port is an election element that generates ejection energy for ejecting ink. The drive of each ejection element is controlled by a control unit (not shown) based on printing data. Driving the ejection elements causes ink to be ejected from the ejection ports of the printhead 3 and to be landed on a printing medium. As a result, an image is formed on the printing medium. In the present embodiment, ink retained in the ink tank 7 is supplied via a tube. Alternatively, a different mode is possible, in which the ink tank is mounted on the carriage to move in the main scanning direction along with the carriage and the printhead and supply ink to the printhead. Also, the ink tanks 7 of the present embodiment are each fixed in the printing apparatus 1 and configured to be filled with ink through the filling portion, but the ink tank 7 is not limited to this and may instead be of a cartridge type configured to be attachable to and detachable from the printing apparatus 1.

Also, as shown in FIGS. 1B and 1C, an attachment opening 5 is provided at the back surface of the printing apparatus main body 1A forming the outer shell of the printing apparatus 1. The attachment opening 5 is provided for attachment and detachment of a maintenance cartridge (liquid storing container) 50 to be described later. FIG. 1B shows the maintenance cartridge 50 attached inside the printing apparatus main body 1A, and FIG. 1C shows the maintenance cartridge 50 ejected from the printing apparatus main body 1A. The maintenance cartridge 50 is for storing waste ink (waste liquid) which is liquid discharged by a maintenance operation for maintaining and restoring the ink ejection performance of the printhead 3. Once the waste ink stored in the maintenance cartridge 50 reaches a certain amount, a user ejects the attached maintenance cartridge 50 as shown in FIG. 1C and attaches a new maintenance cartridge 50.

Figure 2:
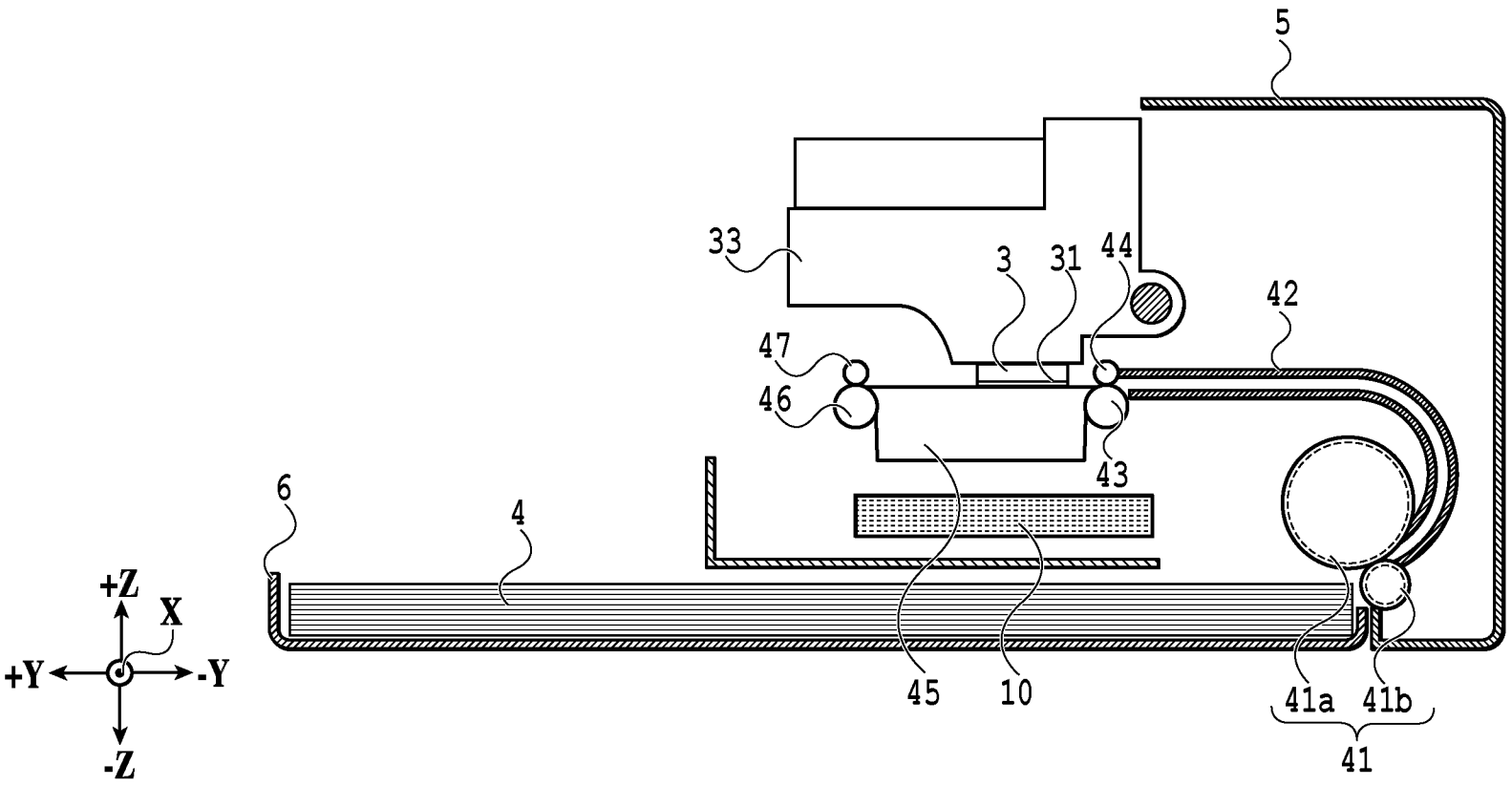
FIG. 2 is a sectional view taken along the line II-II in FIG. 1A.
Figure 3:
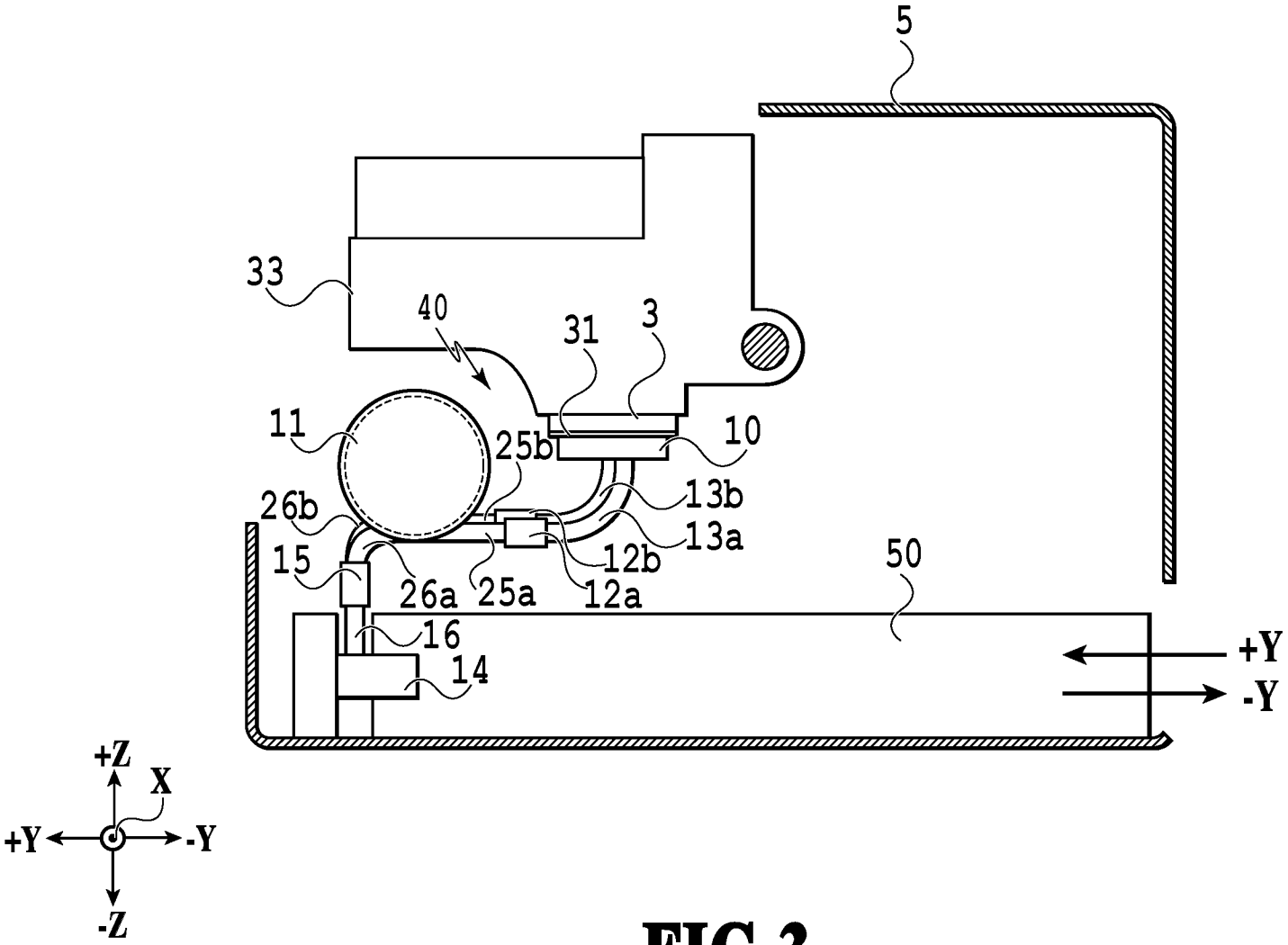
FIG. 3 is a sectional view taken along the line III-III in FIG. 1B.

Next, using FIGS. 2 and 3, a schematic internal configuration of the printing apparatus main body 1A is described. FIG. 2 is a sectional view taken along the line II-II in FIG. 1A. In FIGS. 1A to 1C and 2, a sheet feeding cassette 6 on which to stack sheet-shaped printing media 4, such as printing paper, is detachably attached at the front surface of the printing apparatus main body 1A. The uppermost one of the printing media 4 in the sheet feeding cassette 6 is picked up by a feeding unit 41 having a feeding roller 41a and a pickup roller 41b and is fed to a conveyance path 42 that guides the printing medium 4.

The printing medium 4 fed to the conveyance path 42 is conveyed frontward (+Y-direction) along the upper surface of a platen 45 by a conveyance unit including a conveyance roller 43 and a pinch roller 44 facing the conveyance roller 43. After that, the printing medium 4 is conveyed further frontward by a sheet discharge unit which is driven in synchronization with the conveyance unit, and is discharged onto a discharge tray (not shown). The sheet discharge unit is formed by a discharge roller 46 that rotates in synchronization with the conveyance roller 43 and a spur 47 in pressure contact with the discharge roller 46.

The carriage 33 that reciprocates in the main scanning direction (the X-direction) is provided between the conveyance roller 43 and the discharge roller 46 in the front-rear direction (the Y-direction) of the printing apparatus 1. The printhead 3 is mounted on the bottom portion of the carriage 33 and moves in the main scanning direction (the X-direction) along with the carriage 33. An ejection port surface 31 is formed on the bottom portion of the printhead 3, the ejection port surface 31 having arrays of a plurality of ejection ports through which ink is ejected. The ejection port surface 31 is disposed to face the printing medium 4 with a predetermined gap therebetween, the printing medium 4 being conveyed thereto along the upper surface of the platen 45. Ink ejected from the ejection ports lands on the printing medium 4, forming an image.

The printing apparatus 1 also has a maintenance unit that performs a maintenance operation for maintaining and restoring the ink ejection performance of the printhead 3. In the present embodiment, the printing apparatus 1 includes, as the maintenance unit, a suction recovery mechanism 40 that forces air bubbles, thickened ink, and the like existent in the printhead 3 and in the ejection ports to be sucked and discharged from the ejection ports, a wiping mechanism (not shown) that wipes off excess ink attached to the surface of the printhead 3, and the like. The printing apparatus 1 may include, as the maintenance unit, a pressurization recovery mechanism that forces ink to be discharged from the ejection ports by applying a positive pressure to the inside of the printhead 3. The ink discharged by the maintenance unit is not suitable for image formation and is therefore discharged, through an ink discharge path, to a liquid storing container (the maintenance cartridge 50) to be described in detail later.

FIG. 3 is a diagram showing schematic configurations of the maintenance cartridge 50 and the suction recovery mechanism 40 as the maintenance unit provided to the printing apparatus 1 of the present embodiment. FIG. 3 is a sectional view taken along the line III-III in FIG. 1B. The suction recovery mechanism 40 is provided at a position (a recovery operation position) outside a printing region (e.g., the region where a printing medium passes) inside the printing apparatus main body 1A. The suction recovery mechanism 40 includes a cap 10 capable of coming into close contact and out of contact with the ejection port surface 31 of the printhead 3, a suction pump 11 as a negative pressure generation unit that applies a negative pressure to the cap 10, a waste ink discharge portion 14, and tubes and joints for linking them.

The cap 10 is provided capable of coming into close contact and out of contact with the ejection port surface 31 of the printhead 3 located at the recovery operation position. In a capping state in which the cap 10 is in close contact with the ejection port surface 31, the cap 10 is configured to cover the ejection ports provided at the ejection port surface 31. In the present embodiment, the cap 10 is made of an elastic material having no air permeability, such as rubber, and an annular sealing rib (not shown) is formed along the perimeter of the cap 10, the sealing rib being capable of coming into close contact and out of contact with the ejection port surface 31. The cap 10 comes into close contact and out of contact with the ejection port surface 31 by being moved up and down by an up-and-down mechanism (not shown). The cap 10 is brought to the capping state while a printing operation is not performed, so that the cap 10 can protect the ejection ports and mitigate evaporation of the ink inside the ejection ports. The cap 10 of the present embodiment includes a color cap for capping an ejection port surface 31 having arrays of ejection ports for color ink and a black cap for capping an ejection port surface 31 having arrays of ejection ports for black ink. The color cap and the black cap may be formed of separate components or may be partitioned by a rib or the like.

The cap 10 and the suction pump 11 are also used for, e.g., suction recovery processing or pressurization recovery processing, which is recovery processing for refreshing the ink inside the ejection ports in the printhead 3. The suction recovery processing is performed by activating the suction pump 11 to generate a negative pressure inside the cap 10 with the cap 10 being in close contact with the ejection port surface 31 and sealing the ejection ports (the capping state). This forces ink containing air bubbles, dust, thickened ink, or the like to be sucked and discharged from the ejection ports, thereby replacing the ink in the ejection ports with non-thickened ink. The waste ink sucked from the ejection ports of the printhead 3 is received by the cap 10, is then sent from the cap 10 to the waste ink discharge portion 14 through tubes to be described later by the action of the suction pump 11, is sent from the waste ink discharge portion 14 to the maintenance cartridge 50 to be described later, and is stored in the maintenance cartridge 50.

Meanwhile, the pressurization recovery processing is processing for refreshing ink in the ejection ports by applying a positive pressure into the printhead 3 and forcing the ink to be discharged from the ejection ports with the ejection port surface 31 facing the cap 10 or an ink receiver (not shown). As the processing for refreshing ink in the ejection ports, there is also what is called preliminary ejection, in which the ejection elements provided inside the ejection ports are driven to perform non-printing ink ejection toward the cap 10. Preliminary ejection is typically performed toward the cap 10, and the ink ejected to the cap 10 is discharged to the maintenance cartridge 50 via the tubes and the waste ink discharge portion 14, like in the other recovery processing.

Note that various forms of pumps may be used as the suction pump 11 as long as the pump can generate a negative pressure. In the present embodiment, a tube pump used as the suction pump 11 generates a negative pressure inside a tube communicating with the cap 10 by pushing and squeezing the tube with a roller.

Next, a description is given of a path for waste ink from the cap 10 to the waste ink discharge portion 14. One end portions of cap tubes 13*a*, 13*b* are connected to the cap 10. The other end portions of the cap tubes 13*a*, 13*b* are connected to one end portions of inlet tubes 25*a*, 25*b* of the suction pump 11 via joints 12*a*, 12*b*, respectively. The other end portions of the inlet tubes 25*a*, 25*b* are connected to the entry of the suction pump 11. One end portions of outlet tubes 26*a*, 26*b* are connected to the exist of the suction pump 11, and the other end portions of the outlet tubes 26*a*, 26*b* are connected to one end portion of a drain tube 16 via a joint 15.

The other end portion of the drain tube 16 is connected to the waste ink discharge portion 14 to which the maintenance cartridge 50 can be detachably attached. The waste ink discharge portion 14 is supported by the bottom portion of the printing apparatus main body 1A. Note that black ink discharged from the black cap flows through the cap tube 13*a*, the joint 12*a*, the inlet tube 25*a*, and the outlet tube 26*a*, whereas color ink discharged from the color cap flows through the cap tube 13*b*, the joint 12*b*, the inlet tube 25*b*, and the outlet tube 26b.

Operating the suction pump 11 causes waste ink discharged into the cap 10 to enter the suction pump 11 via the cap tubes 13*a*, 13*b* and the inlet tubes 25*a*, 25*b*. After that, the waste ink is sent to the waste ink discharge portion 14 via the suction pump 11, the outlet tubes 26*a*, 26*b*, the joint 15, and the drain tube 16, and is discharged from the waste ink discharge portion 14 to the maintenance cartridge 50. The waste ink in the outlet tube 26*a* and the waste ink in the outlet tube 26*b* are combined at the joint 15 and are discharged from the single waste ink discharge portion 14 to the maintenance cartridge 50. Since waste ink is thus introduced into the maintenance cartridge 50 through a single location, the work for attachment and detachment of the maintenance cartridge 50 is simplified, and also, the risk of leakage of the waste ink can be reduced.

Figure 4B:
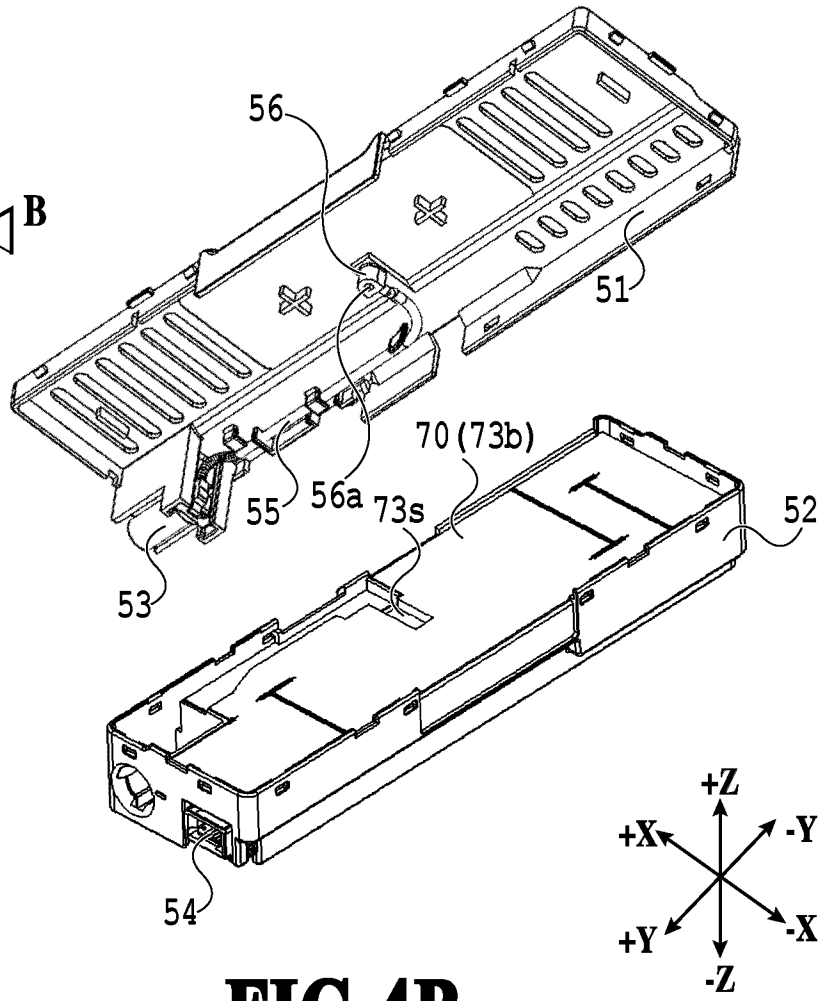
FIG. 4B is an exploded perspective view of the maintenance cartridge shown in FIG. 4A.
Figure 4A:
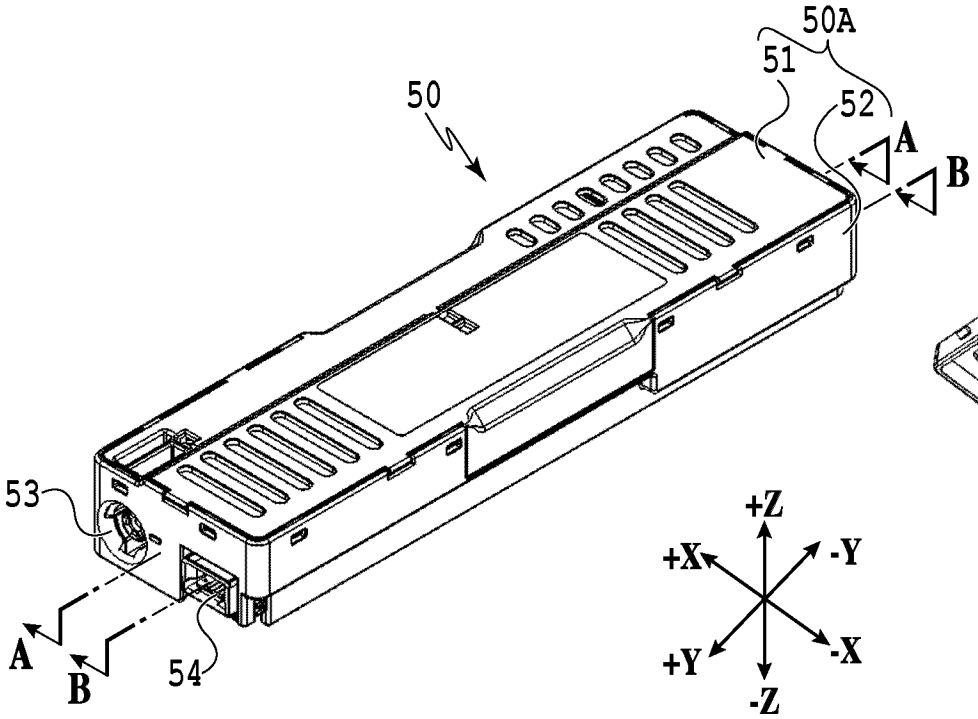
FIG. 4A is a perspective view of a maintenance cartridge according to a first embodiment.

Next, the configuration of the maintenance cartridge 50 of the present embodiment is described. FIGS. 4A and 4B are each a perspective view of the maintenance cartridge 50, FIG. 4A being an external perspective view of the maintenance cartridge 50 and FIG. 4B being an exploded perspective view showing the internal configuration of the maintenance cartridge 50.

First, an overview of the maintenance cartridge 50 is described using FIG. 4A. The maintenance cartridge 50 is configured to be attachable to and detachable from the printing apparatus 1 and can be replaced by a user. The maintenance cartridge 50 has a casing 50A including a case unit 52 having an open top and a cover unit 51 that covers the opening of the case unit 52. The casing 50A is shaped substantially like a cuboid which is long in the front-rear direction (the Y-direction) and short in the left-right direction (the X-direction). The front wall portion of the casing 50A is provided with a waste ink introduction portion (an introduction portion) 53 and a detection portion 54.

Once the maintenance cartridge 50 is inserted to the printing apparatus 1, the waste ink discharge portion 14 is inserted to the introduction portion 53, and a detector (not shown) provided at the printing apparatus main body 1A is inserted to the detection portion 54. The detector outputs, to a control unit (not shown), a signal indicating whether the maintenance cartridge 50 is properly attached to the printing apparatus main body 1A. When it is determined based on the signal from the detector that the maintenance cartridge 50 is not properly attached, the control unit prohibits the suction pump 11 to perform the recovery operation, thereby inhibiting waste ink from leaking from the connection between the printing apparatus main body 1A and the maintenance cartridge 50. Note that in a normal use usage posture in which the bottom portion of the printing apparatus main body 1A is horizontal, the bottom portion of the casing 50A of the maintenance cartridge 50 attached to the printing apparatus main body 1A is kept horizontal.

Next, the internal configuration of the maintenance cartridge 50 is described using FIG. 4B. As described earlier, the casing 50A forming the outer shell of the maintenance cartridge 50 is formed by the case unit 52 and the cover unit 51. FIG. 4B shows the inner side of the cover unit 51. The cover unit 51 is provided with the tubular introduction portion 53 into which the waste ink discharge portion 14 provided at the printing apparatus 1 is to be inserted. A tube 55 is linked to the introduction portion 53. The tube 55 is attached along the inner surface of the cover unit 51 and is linked to a discharge portion 56 located upward of the introduction portion 53 in the direction of gravitational force. The discharge portion 56 is formed at a position protruding from the inner surface of the cover unit 51 downward in the direction of gravitational force and discharges liquid from a discharge opening 56*a* formed at the lower end portion of the discharge portion 56.

In the cover unit 51 thus configured, waste ink discharged by the suction recovery mechanism 40 is introduced from the waste ink discharge portion 14 to the introduction portion 53 and is then discharged via the tube 55 from the discharge opening 56*a* of the discharge portion 56 downward in the direction of gravitational force. Although the introduction portion 53 is provided at the cover unit 51 in the present embodiment, the introduction portion 53 may be provided at the case unit 52. Also, although the discharge portion 56 is formed in such a manner as to discharge waste ink downward in the direction of gravitational force from the cover unit 51, the discharge portion 56 may instead be disposed in such manner as to discharge waste ink horizontally. Alternatively, the waste ink may be discharged directly from the tube 55.

Next, the internal configuration of the case unit 52 is described. As shown in FIG. 4B, the case unit 52 is provided with a liquid absorber 70. This liquid absorber 70 has a stacking structure in which a plurality of absorbers are stacked on one another, and an absorber layer 73*b* shown in FIG. 4B is disposed as its uppermost layer.

Figure 5:
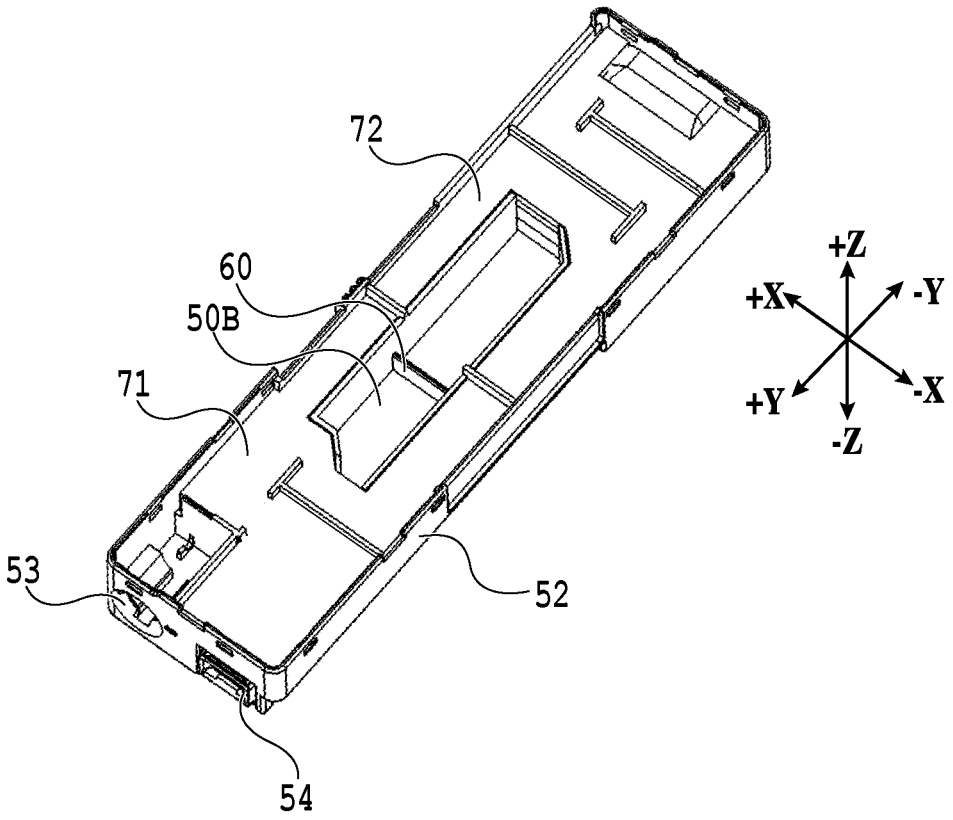
FIG. 5 is a perspective view showing the maintenance cartridge shown in FIG. 4A without an upper absorber.

FIG. 5 is a perspective view showing the internal configuration of the case unit 52 without an upper absorber 73 formed by the absorber layer 73*b* and an absorber layer 73*a* immediately below the absorber layer 73*b* (see FIG. 6B). As shown in FIG. 5, the case unit 52 also has absorbers 71, 72 disposed below the upper absorber 73. The absorber 71 is located on the front side (+Y side) in the maintenance cartridge 50, and the absorber 72 is located at the back side (-Y side) in the maintenance cartridge 50. The absorbers 71, 72 are configured so that they are separated from each other in the front-rear direction (the Y-direction) and do not touch each other. An introduction space 50B is formed, surrounded by the absorbers 71, 72 and the bottom portion of the case unit 52. No absorber is housed in the introduction space 50B, exposing the bottom portion of the case unit 52. A liquid divider 60 is provided on the bottom portion of the case unit 52, protruding to partition the lower part of the introduction space 50B in the front-rear direction. The liquid divider 60 is provided at a position facing the discharge opening 56*a* of the discharge portion 56. The liquid divider 60 of the present embodiment is formed by a flat-plate-shaped protrusion extending in the left-right direction.

Figure 6A:
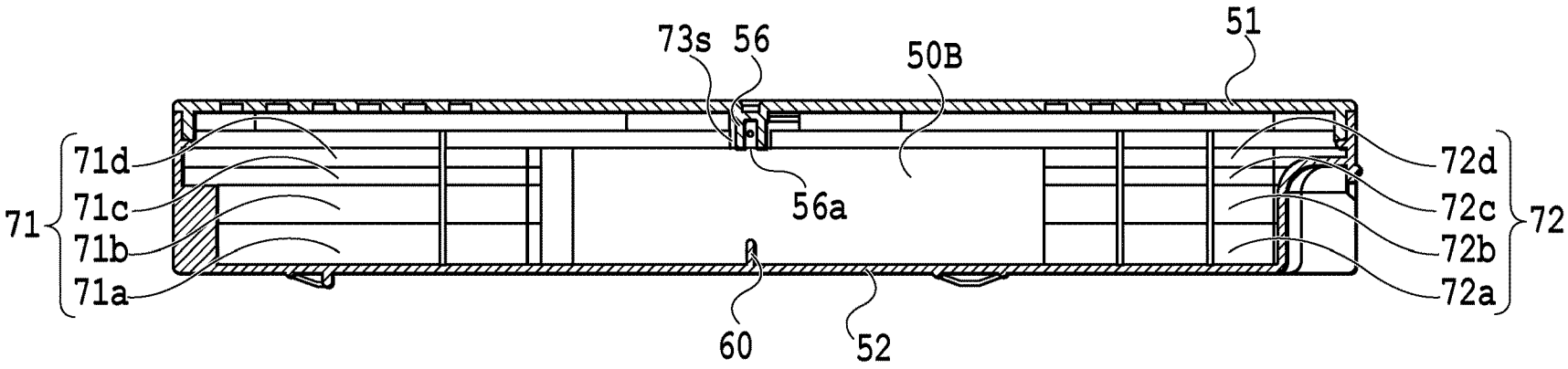
FIG. 6A is a sectional view taken along the line A-A in FIG. 4A.
Figure 6B:
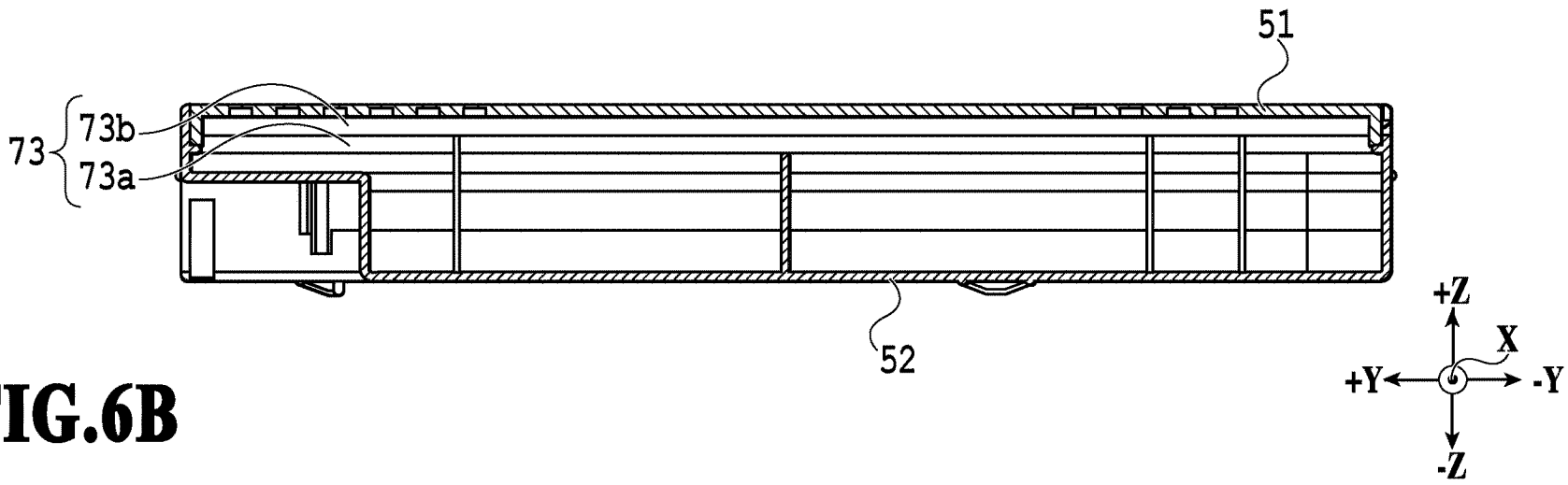
FIG. 6B is a sectional view taken along the line B-B in FIG. 4A.

The internal configuration of the maintenance cartridge 50 is further described using FIGS. 6A and 6B which are sectional views of the maintenance cartridge 50. FIG. 6A is a sectional view taken along the line A-A in FIG. 4A, and FIG. 6B is a sectional view taken along the line B-B in FIG. 4B. As shown in FIGS. 6A and 6B, the absorber 71 located on the front side in the maintenance cartridge 50 is configured as a stack of a plurality of (four here) absorber layers 71*a* to 71*d* parallel to the XY-plane, and the absorber 72 located on the back side in the maintenance cartridge 50 is configured as a stack of a plurality of (four here) absorber layers 72*a* to 72*d* parallel to the XY-plane. Although the thickness and the number of the absorber layers of each of the absorber 71 and the absorber 72 are the same in the present embodiment, the thickness and the number of the absorber layers of each absorber may be different.

An opening portion of the introduction space 50B formed between the absorber 71 and the absorber 72 is covered by the upper absorber 73 that covers the upper surfaces of the absorbers 71 and 72. The two absorber layers 73*a*, 73*b* that form the upper absorber 73 are each formed by a single absorber material extending along the XY-plane. The outer surface (the upper surface) of the upper absorber 73 is covered by the cover unit 51. The discharge portion 56 connected to an end of the tube 55 provided on the inner surface of the cover unit 51 is inserted into a slit 73s formed in the upper absorber 73, and the aforementioned introduction space 50B is located below the discharge portion 56 in the direction of gravitational force. Thus, ink discharged from the discharge portion 56 is stored in the introduction space 50B.

In the present embodiment, the absorbers 71, 72 are each formed by a plurality of absorber layers disposed on the XY-plane and stacked in the Z-direction. However, the configurations of the absorbers 71, 72 are not limited to this. The absorbers 71, 72 may instead be formed by absorber layers disposed on the XZ-plane and stacked in the Y-direction or by absorber layers disposed on the YZ-plane and stacked in the X-direction.

Figures 7A, 7B, 7C:
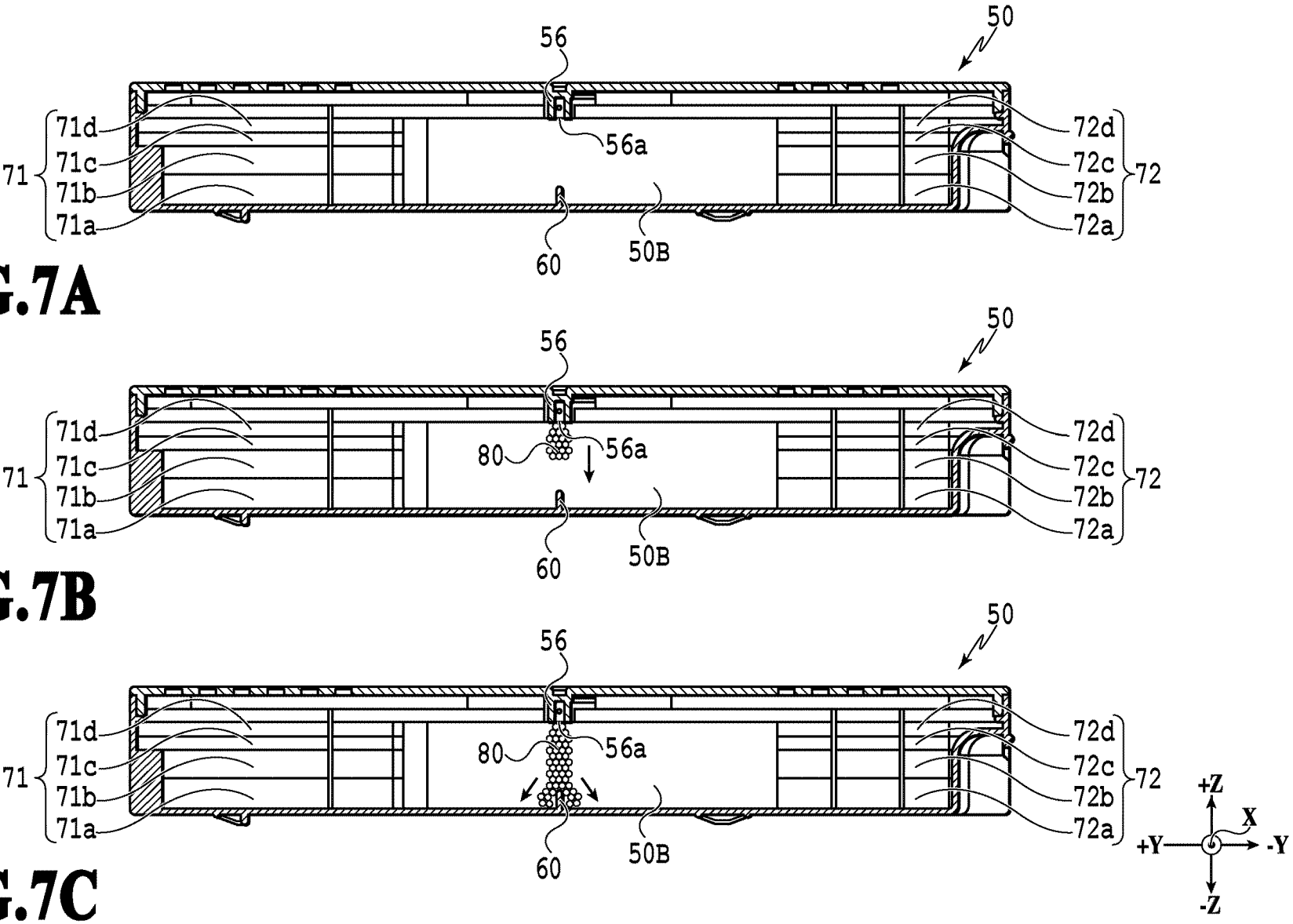
FIGS. 7A to 7C are sectional views showing the behavior of waste ink in the maintenance cartridge shown in FIG. 4A.

Next, using FIGS. 7A to 7C, a description is given of the behavior of waste ink discharged in the maintenance cartridge 50 thus configured. FIGS. 7A to 7C are sectional views of the maintenance cartridge 50 shown in FIG. 4A taken along the line A-A. Once waste ink is discharged from the waste ink discharge portion 14 of the suction recovery mechanism 40 after the maintenance cartridge 50 is attached to the printing apparatus main body 1A, the waste ink flows through the tube 55 and is discharged from the discharge portion 56 to the introduction space 50B. In this event, in a case where the waste ink is, e.g., a pigment ink or a high-concentration ink, the waste ink discharged from the discharge portion 56 is discharged in the form of bubbles in the vicinity of the discharge portion 56 as shown in FIG. 7B. Waste ink 80 discharged in the form of bubbles moves down in the direction of gravitational force toward the liquid divider 60 disposed below the discharge portion 56. After that, the waste ink 80 comes into contact with the liquid divider 60 as shown in FIG. 7C, and is divided to the front side and to the back side in the maintenance cartridge 50. Then, the waste ink 80 divided to the front side is absorbed by the absorber 71 disposed on the front side, and the waste ink 80 divided to the back side is absorbed by the absorber 72 disposed on the back side.

In this way, in the present embodiment, the liquid divider 60 is provided so that the waste ink 80 discharged from the discharge portion 56 may be distributed to and absorbed by the absorbers 71 and 72, instead of being absorbed by a single absorber at the same location. As a result, the waste ink is distributed over a wide area in the liquid absorber 70 and absorbed, which makes it possible to reduce the risk of the waste ink seeping through the maintenance cartridge 50 in an event where the printing apparatus 1 is tilted greatly during, e.g., transport or disposal.

A more specific description is given of the behavior of the waste ink 80 discharged from the liquid absorber 70 in order to describe the advantageous effects offered by the present embodiment. The waste ink 80 discharged from the liquid absorber 70 permeates into and is spread in the liquid absorber 70. The permeation and spread of the waste ink is caused by capillary force (meniscus force) generated in the absorber, and the waste ink spreads not only horizontally, but also vertically upwards against the gravitational force. However, such spreading force is limited, and in an absorber of a certain size or larger, the region where the absorbed waste ink is retained is concentrated in a lower side in the direction of gravitational force. In a case where the maintenance cartridge 50 is tilted in a direction to have a larger tilt angle while there is such concentration of the ink retention region, the waste ink absorbed inside the liquid absorber 70 moves to and is collected in an even lower side in the direction of gravitational force. Then, the collected waste ink may exceed the absorption limit of the liquid absorber 70 and seep through the maintenance cartridge 50.

Thus, in the present embodiment, as shown in FIGS. 5, 6A, and 6B, the liquid absorber 70 provided inside the maintenance cartridge 50 is divided into two absorbers arranged in the front-rear direction so that each of the absorbers may have a certain length or less. Also, the present embodiment employs a configuration such that waste ink discharged from the discharge portion 56 is distributed to each of the absorbers by the liquid divider 60. The maintenance cartridge 50 in the present embodiment is long in the front-rear direction (the Y-direction), and the liquid absorber 70 is divided into absorbers arranged in the longitudinal direction of the maintenance cartridge 50. This allows each of the absorbers to be short both in the X-direction and in the Y-direction and thus allows reduction of the risk of ink seeping (leaking) in an event where the maintenance cartridge 50 is tilted largely along with the printing apparatus 1. Note that the positions of the discharge portion 56 and the liquid divider 60 are desirably set near the center portion of the maintenance cartridge 50 in the longitudinal direction. This allows the lengths of the absorbers in the front-rear direction (the longitudinal direction) to be short and equal, making it possible to further reduce the risk of ink seeping in an event of a large tilt.

Second Embodiment

Figures 8A, 8B, 8C:
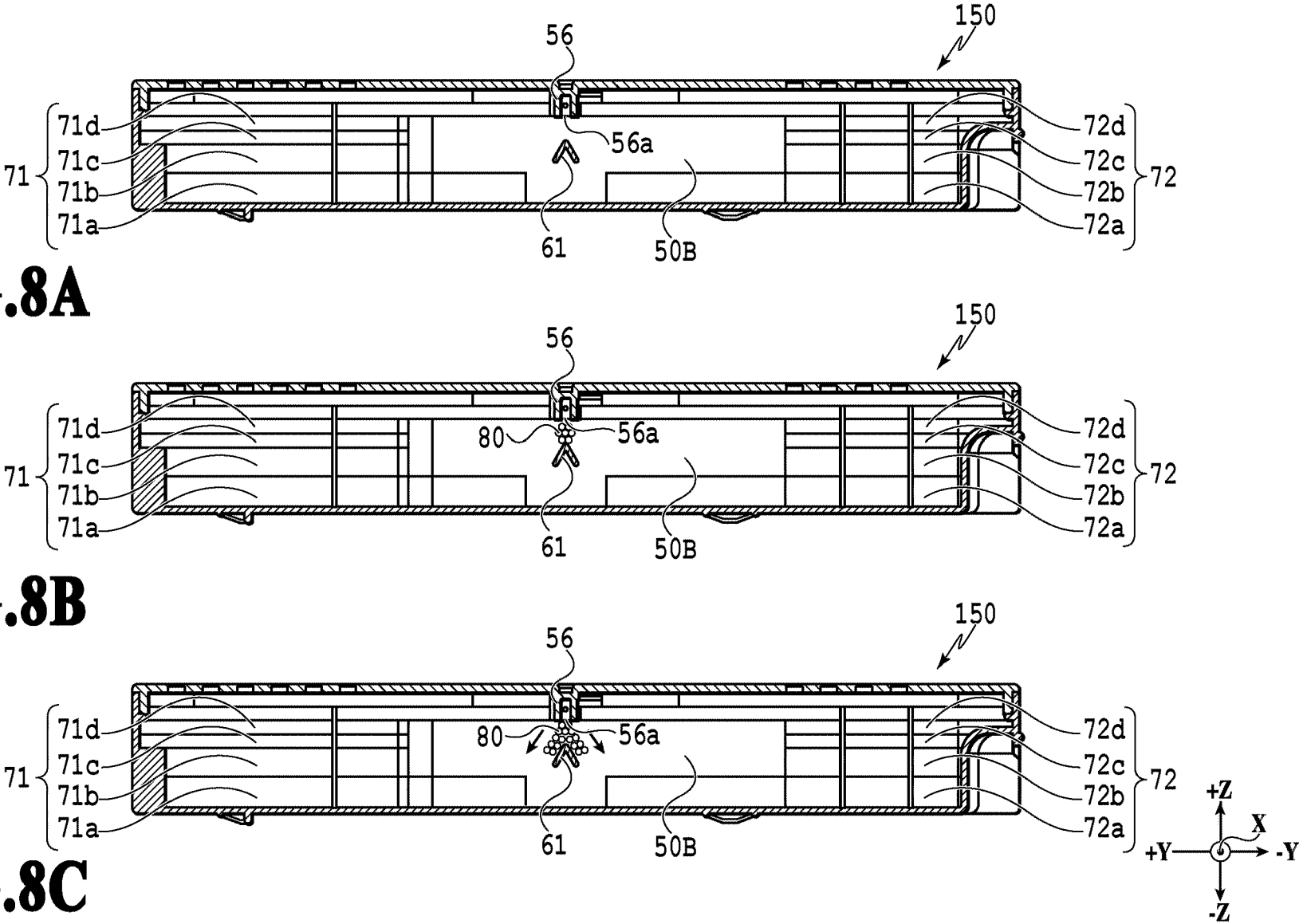
FIGS. 8A to 8C are sectional views showing the behavior of waste ink in a maintenance cartridge according to a second embodiment.

Next, a second embodiment of the present disclosure is described. The overall configuration of the printing apparatus of the present embodiment is the same as that of the first embodiment and is therefore not described here. With reference to FIGS. 8A to 8C, the following describes the configuration of and the advantageous effects offered by a maintenance cartridge 150 of the present embodiment. Note that in FIGS. 8A to 8C, portions that are the same as those in the above embodiment are denoted by the same reference numerals as those used in the above embodiment.

As shown in FIG. 8A, in the maintenance cartridge 150 of the present embodiment, the liquid divider 61 is disposed below the discharge portion 56 in the direction of gravitational force, extending in the left-right direction (the X-direction). The liquid divider 61 has a cross section in the shape of an inverted letter V and is spaced away from the bottom surface of the case unit 52 upwards in the direction of gravitational force.

FIGS. 8B and 8C are diagrams showing the behavior of waste ink 80 discharged from the discharge portion 56. As described earlier, in a case where the waste ink discharged from the discharge portion 56 is a pigment ink or a high-concentration ink, the waste ink is discharged in the form of bubbles as shown in FIG. 8B. The waste ink 80 discharged from the discharge portion 56 in the form of bubbles comes into contact with the liquid divider 61 disposed below the discharge portion 56 in the direction of gravitational force and is divided to the front side and to the back side as shown in FIG. 8C. The waste ink 80 thus divided is absorbed by the absorber 71 on the front side and the absorber 72 on the back side that are disposed near the liquid divider 61.

In this way, in the maintenance cartridge 150 of the present embodiment, the waste ink 80 discharged from the discharge portion 56 is divided by the liquid divider 61 having a cross section in the shape of an inverted letter V so that the waste ink can be distributed to and absorbed by the two absorbers 71 and 72.

Although the liquid divider 61 is provided at a position upwardly spaced from the bottom surface of the case unit 52 in the present embodiment, waste ink can still be distributed to and absorbed by each of the absorbers in this case. In other words, the liquid divider 61 does not need to be provided on the bottom portion of the case unit 52 and may be disposed at any position as long as it can face the discharge portion 56 and receive waste ink at that position. The cross sectional shape of the liquid divider 61 is not limited to the vertical plate shape like in the first embodiment, and may be an inverted letter V shape like in the present embodiment. Also, the liquid divider 61 may be in a different shape as long as it allows the waste ink 80 to be divided and discharged to each of the absorbers.

Third Embodiment

Next, a third embodiment of the present disclosure is described with reference to FIGS. 9A to 9D. Note that the following description focuses on the characteristic configuration and advantageous effects of the present embodiment, and the same portions as those in the first embodiment are denoted by the same reference numerals as those used in the first embodiment to omit repetitive description. A liquid divider 62 in the maintenance cartridge 250 of the present embodiment is also disposed below the discharge portion 56 in the direction of gravitational force. The liquid divider 62 is, as in the first embodiment, provided on the bottom surface of the case unit 52. However, the liquid divider 62 in the present embodiment has a larger height H than that in the first embodiment.

FIGS. 9A to 9D show a state where the maintenance cartridge 250 is being used while tiled along with the printing apparatus. The maintenance cartridge 250 is tilted to the front side at an angle θ relative to the horizontal direction (the Y-direction). In this case, the waste ink 80 behaves as follows.

Figure 9A:
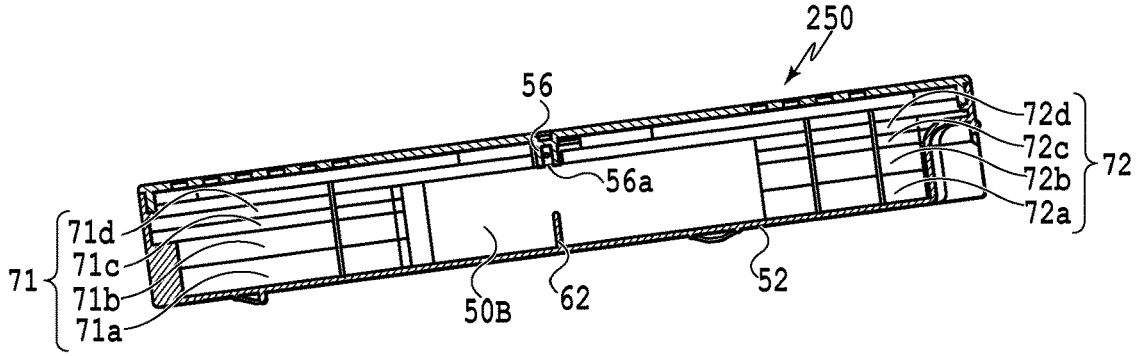
FIGS. 9A to 9D are sectional views showing the behavior of waste ink in a maintenance cartridge according to a third embodiment.
Figure 9B:
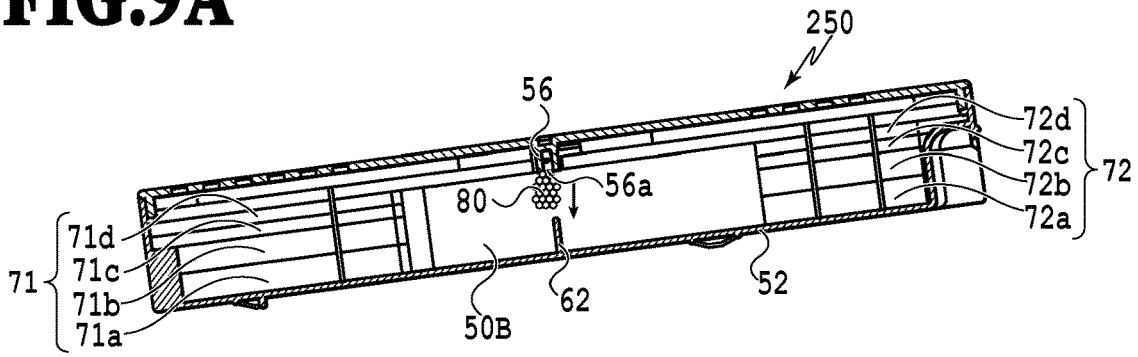
Figure 9C:
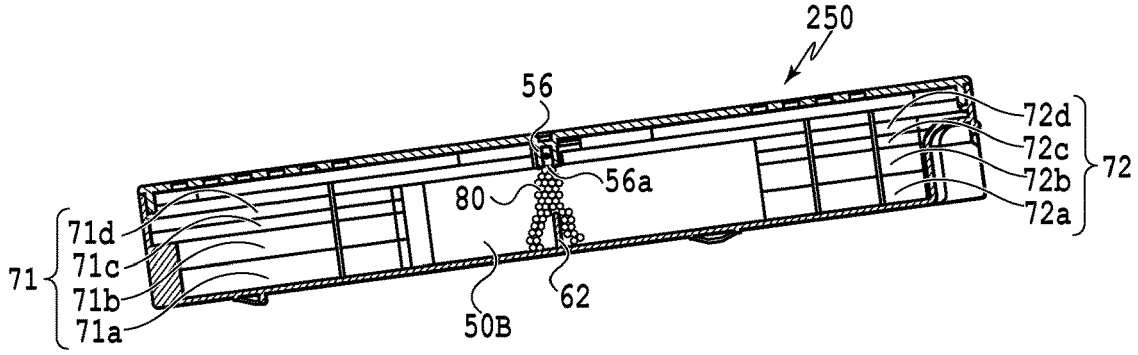
Figure 9D:
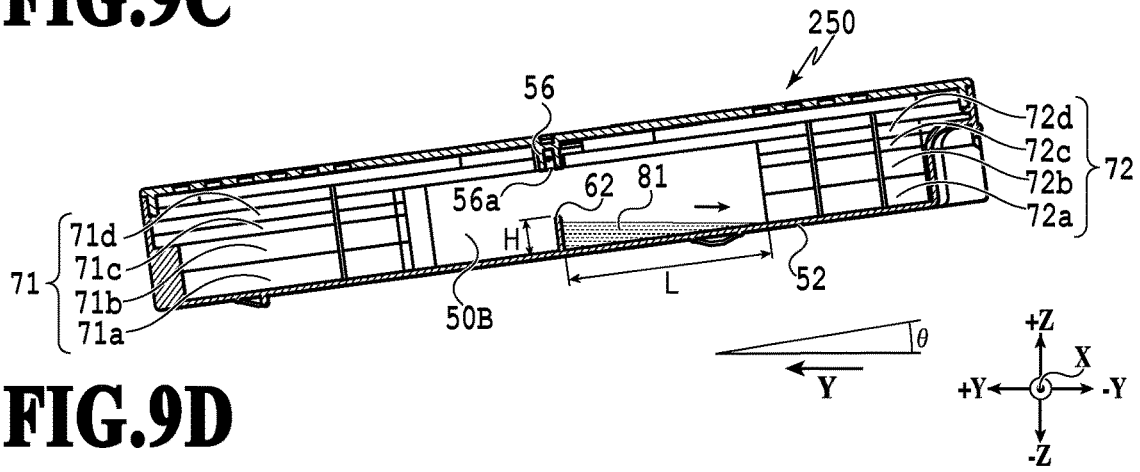

A pigment ink or a high-concentration ink is discharged in the form of bubbles down in the direction of gravitational force from the discharge portion 56 as shown in FIG. 9B. The waste ink 80 discharged in the form of bubbles comes into contact with the liquid divider 62 and is thereby divided to the front side (the +Y side) and to the back side (the −Y side). The ink divided to the back side is defoamed and is retained in a region formed by the liquid divider 62 and the bottom surface of the case unit 52 as shown in FIG. 9D, becoming accumulated ink 81. Even in a state where the printing apparatus as a whole is tilted frontward at the angle θ, the waste ink divided to the back side does not flow to the front side but stays and accumulates in the back side. Thus, the waste ink divided to the back side can be absorbed by the absorber 72 on the back side before flowing beyond the liquid divider 62. As a result, ink discharged from the discharge portion 56 can be distributed to and absorbed by the absorber 72 on the back side and the absorber 71 on the front side.

In order for the waste ink divided by the liquid divider 62 to accumulate and stay on the side to which it has been divided even with the maintenance cartridge 250 tilted, the distance L between the liquid divider 60 and the absorber 72 and the height H of the liquid divider 62 need to be set to satisfy the following formula:

$$H \geq L\tan\theta.$$

Desirably, the tile angle θ of the maintenance cartridge 250 is set to 5° or greater so as to be able to cover most of usage situations for the user, and the height H of the liquid divider 62 is set accordingly. In the example shown in the present embodiment, the distance L is constant irrespective of the direction to which the waste ink is divided. However, in a case where the length of the distance L is difference for each direction to which the waste ink is divided, it is preferable to set the height H according to that distance.

If there were no liquid divider 62 in the maintenance cartridge 250 shown in FIGS. 9A to 9D, the waste ink 80 would be absorbed only by the absorber 71. In the maintenance cartridge 250 of a long shape like in the present embodiment, there is a limit as to an area over which the waste ink can be spread by the capillary force of the absorber, and it is unlikely that the waste ink is spread to the absorber 72 by the capillary force. In a case where the tilt angle θ of the maintenance cartridge 250 becomes greater in this state during transport or disposal, the ink may seep through the maintenance cartridge 250 as described earlier. According to the present embodiment, the waste ink is distributed to the absorbers 71, 72 as described above, and thus seeping of waste ink through the maintenance cartridge 250 can be reduced.

Fourth Embodiment

Next, a maintenance cartridge 350 of a fourth embodiment of the present disclosure is described with reference to FIGS. 10, 11A, and 11B. Note that in the present embodiment, the same portions as those in the first embodiment are denoted by the same reference numerals as those used in the first embodiment to omit repetitive description.

Figure 10:
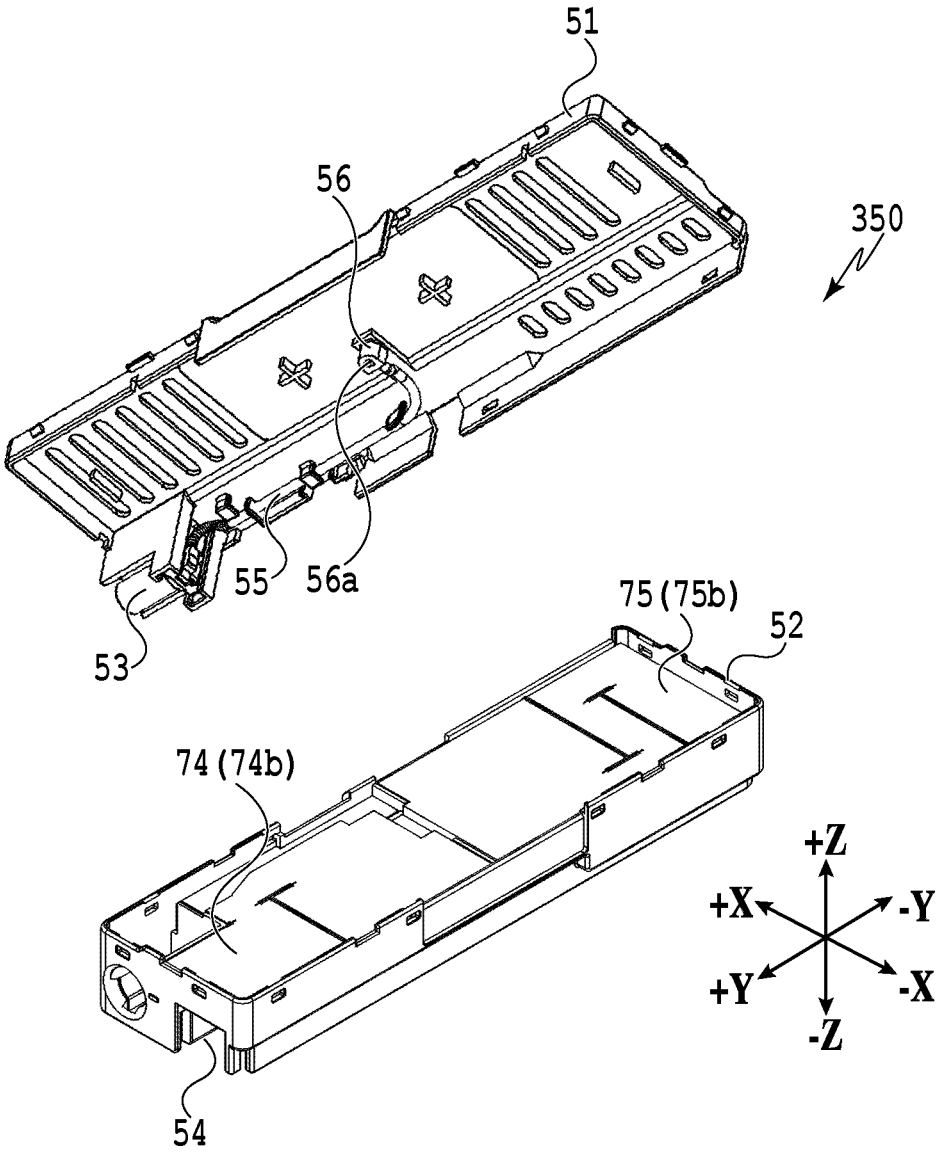
FIG. 10 is an exploded perspective view of a maintenance cartridge according to a fourth embodiment.
Figure 11A:
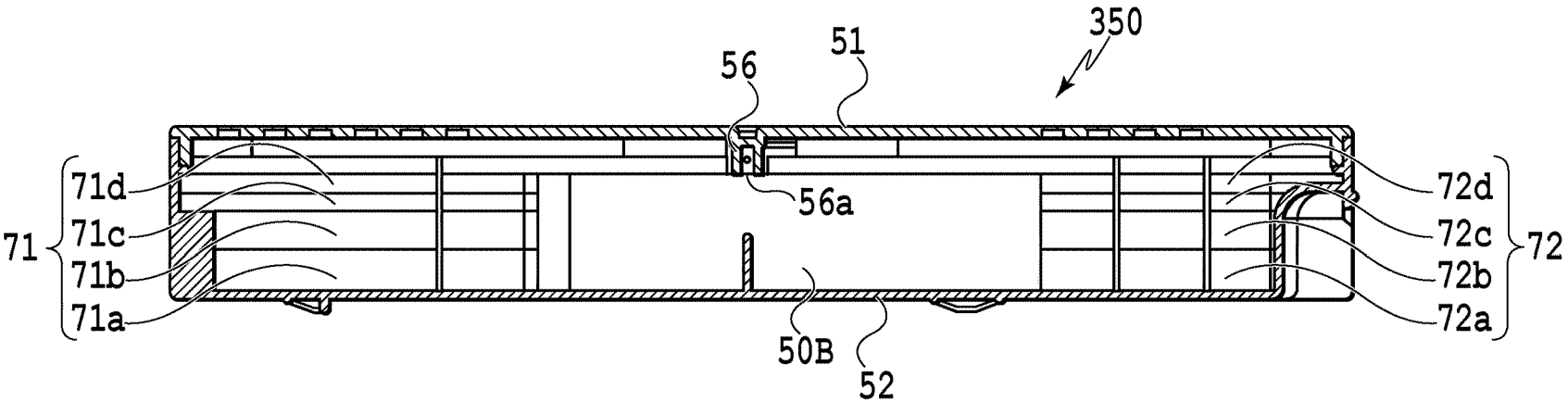
FIGS. 11A and 11B are longitudinal sectional side views of the maintenance cartridge shown in FIG. 10.
Figure 11B:
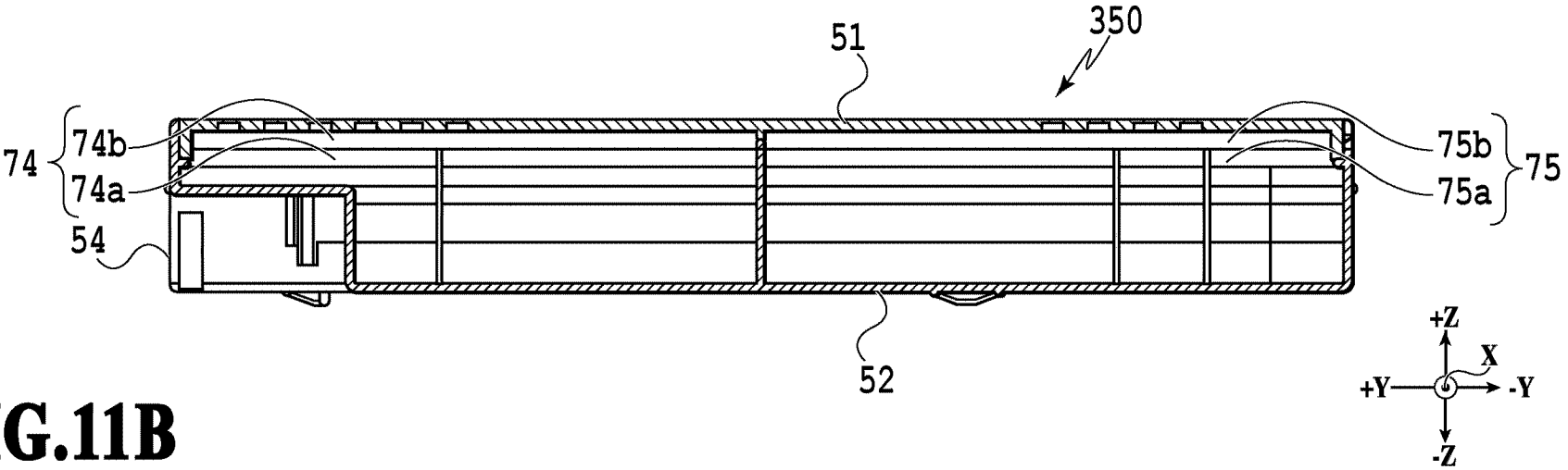

FIG. 10 is an exploded perspective view showing the internal structure of the maintenance cartridge 350. Also, FIGS. 11A and 11B are longitudinal sectional side views of the maintenance cartridge 350 shown in FIG. 10, FIG. 11A being a longitudinal sectional side view of a center portion of the maintenance cartridge 350 and FIG. 11B being a longitudinal sectional side view of an edge portion of the maintenance cartridge 350.

In the example described in the first embodiment, the upper absorber 73 covering the upper surfaces of the absorbers 71, 72 is formed by the two upper and lower absorber layers 73*a*, 73*b*, and each of the absorber layers 73*a*, 73*b* is formed by a single absorber material extending along the XY-plane. By contrast, the upper absorber in the present embodiment is formed by a front-side absorber 74 and a back-side absorber 75 which are separated from each other in the front-rear direction (the Y-direction), so that there is no communication of liquid therebetween. The front-side absorber 74 is formed by a plurality of (two in this example) absorber layers 74*a*, 74*b* stacked vertically, and the back-side absorber 75 is formed by a plurality of (two in this example) absorber layers 75*a*, 75*b* stacked vertically. The other configurations are the same as those in the first embodiment.

As thus described, in the present embodiment, the upper absorber is formed by the front-side absorber 74 and the back-side absorber 75. The front-side absorber 74 and the back-side absorber 75 are separated from each other in the front-rear direction, so that there is no communication of liquid therebetween. For this reason, in a case where the maintenance cartridge 350 tiles along with the printing apparatus at a large angle, e.g., approximately 90°, delivery (movement) of the waste ink 80 in the front-rear direction of the printing apparatus (the Y-direction) can be reduced. In other words, delivery of ink between the absorber 71 and the absorber 72 can be blocked. With a tilt in the normal usage situations, delivery (movement) of ink does not take place in any of the configurations of the first to third embodiments described above, either. However, in a case where a maintenance cartridge is housed in an external box such as a cardboard box and is tilted at 90° during transport, there is a risk of ink flowing into a lower portion if the maintenance cartridge is configured to allow communication of liquid between absorbers. According to the present embodiment, even in a case where the maintenance cartridge 350 tilts at a large angle in the front-rear direction, concentration of ink in the absorber located at a lower side can be reduced, and therefore seeping of waste ink through the maintenance cartridge 350 can be reduced.

Other Embodiments

In the examples described in the above embodiments, a plurality of different absorbers 71 and 72 separated from each other are provided inside the casing 50A. However, the present disclosure is not limited to this. For example, a single-piece absorber in which an introduction space is formed may be provided inside the casing 50A, and liquid discharged from the discharge portion 56 may be divided and discharged to different locations in the absorber by a liquid divider. The liquid to be absorbed by the absorber can be distributed in this case as well.

In each of the above embodiments, a serial-type printing apparatus that performs printing by moving the printhead in the main scanning direction while conveying a printing medium intermittently is described as an example. However, the present disclosure is not limited to this. The present disclosure is also applicable to a full-line-type printing apparatus that performs printing on a printing medium that is continuously conveyed, using a long printhead having ejection ports over a region covering the width of the printing medium. In this case, as the discharge unit that causes ink to be discharged from the printhead, a pressurization discharge unit can be used which is configured to apply a positive pressure into the printhead to forcibly discharge the ink from the ejection ports.

Also, although an example is described above where the maintenance cartridge (waste liquid storing container) is detachably provided to the printing apparatus main body, the present disclosure is also effective for a configuration in which the waste liquid storing container is affixed to the printing apparatus main body.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-023401, filed Feb. 17, 2021, which is hereby incorporated by reference wherein in its entirety.

What is claimed is:

1. A liquid storing container comprising:

a liquid absorber that absorbs liquid;

a casing that houses the liquid absorber;

a discharge portion that discharges liquid down in a direction of gravitational force into the casing;

an introduction space into which the liquid from the discharge portion is introduced; and a liquid divider provided inside the introduction space, the liquid divider dividing the liquid discharged from the discharge portion toward different locations in the casing, wherein the liquid divider is provided at a position facing the discharge portion in the direction of gravitational force.

2. The liquid storing container according to claim 1, wherein the liquid absorber includes a plurality of different absorbers that are in contact with the introduction space and are separated away from each other, and the liquid divider divides the liquid discharged from the discharge portion toward each of the plurality of absorbers.

3. The liquid storing container according to claim 2, wherein the plurality of absorbers are disposed at different positions in the casing in a longitudinal direction of the casing.

4. The liquid storing container according to claim 3, wherein there is no communication of liquid between the plurality of absorbers.

5. The liquid storing container according to claim 2, wherein there is no communication of liquid between the plurality of absorbers.

6. The liquid storing container according to claim 1, wherein the liquid absorber includes a plurality of different absorbers that are in contact with the introduction space and are separated away from each other, and the liquid divider divides the liquid discharged from the discharge portion toward each of the plurality of absorbers.

7. The liquid storing container according to claim 1, wherein the discharge portion is provided near a center portion of the casing in a longitudinal direction of the casing.

8. The liquid storing container according to claim 1, wherein the liquid divided by the liquid divider is retained in a region formed by the liquid divider and the bottom surface of the casing, and the liquid divider is formed with a height such that with the casing being tilted, the liquid retained in the region is absorbed by the liquid absorber before flowing beyond the liquid divider.

9. The liquid storing container according to claim 1, wherein the liquid divider has a cross section in a shape of an inverted letter V and is formed at a position being upwardly spaced from a bottom surface of the casing and facing the discharge portion.

10. The liquid storing container according to claim 1, wherein the casing is detachably held by a printing apparatus that performs printing using a printhead that ejects liquid, with the casing attached to the printing apparatus, the discharge portion discharges the liquid discharged from the printing apparatus toward the introduction space.

11. A printing apparatus comprising:

a printhead that performs printing by ejecting liquid;

a discharge unit that discharges the liquid from the print head; and a liquid storing container, wherein the liquid storing container includes a liquid absorber that absorbs liquid, a casing that houses the liquid absorber, a discharge portion that discharges liquid down in a direction of gravitational force into the casing, and an introduction space into which the liquid from the discharge portion is introduced, and a liquid divider is provided inside the introduction space, the liquid divider dividing the liquid discharged from the discharge portion toward different locations in the casing, wherein the liquid divider is provided at a position facing the discharge portion in the direction of gravitational force.

12. The printing apparatus according to claim 11, wherein the liquid absorber includes a plurality of different absorbers that are in contact with the introduction space and are separated away from each other, and the liquid divider divides the liquid discharged from the discharge portion toward each of the plurality of absorbers.

13. The printing apparatus according to claim 12, wherein the plurality of absorbers are disposed at different positions in the casing in a longitudinal direction of the casing.

14. The printing apparatus according to claim 11, wherein the liquid absorber includes a plurality of different absorbers that are in contact with the introduction space and are separated away from each other, and the liquid divider divides the liquid discharged from the discharge portion toward each of the plurality of absorbers.

* * * * *